US009706309B2

(12) United States Patent
Xu et al.

(10) Patent No.: US 9,706,309 B2
(45) Date of Patent: Jul. 11, 2017

(54) ACOUSTIC DEVICE

(71) Applicants: Yunxia Xu, Shenzhen (CN); Bin Cai, Shenzhen (CN)

(72) Inventors: Yunxia Xu, Shenzhen (CN); Bin Cai, Shenzhen (CN)

(73) Assignee: AAC TECHNOLOGIES PTE. LTD., Singapore (SG)

( * ) Notice: Subject to any disclaimer, the term of this patent is extended or adjusted under 35 U.S.C. 154(b) by 0 days.

(21) Appl. No.: 15/000,594

(22) Filed: Jan. 19, 2016

(65) Prior Publication Data

US 2016/0227321 A1 Aug. 4, 2016

(30) Foreign Application Priority Data

Feb. 2, 2015 (CN) ..... 2015 2 0072619 U

(51) Int. Cl.

| | |
|---|---|
| ***H04R 1/00*** | (2006.01) |
| ***H04R 7/12*** | (2006.01) |
| ***H04R 7/14*** | (2006.01) |
| *G10K 13/00* | (2006.01) |
| *H04R 7/16* | (2006.01) |

(52) U.S. Cl.

CPC ..... *H04R 7/125* (2013.01); *H04R 7/14* (2013.01); *H04R 7/127* (2013.01); *H04R 7/16* (2013.01); *H04R 2499/11* (2013.01)

(58) Field of Classification Search

CPC ..... H04R 7/14; H04R 2499/11; H04R 1/02; H04R 1/025; H04R 1/2888; H04R 2201/029

USPC ..... 381/346, 332, 423; 181/157

See application file for complete search history.

(56) References Cited

U.S. PATENT DOCUMENTS

| | | | | |
|---|---|---|---|---|
| 5,335,584 A * | 8/1994 | Baird | ..... | F16J 3/02 92/103 F |
| 2014/0079252 A1* | 3/2014 | Klein | ..... | H04R 1/02 381/152 |
| 2014/0301587 A1* | 10/2014 | Ji | ..... | H04R 1/025 381/332 |

* cited by examiner

*Primary Examiner* — Sunita Joshi
(74) *Attorney, Agent, or Firm* — Na Xu; IPro, PLLC

(57) ABSTRACT

One embodiment of the invention discloses an acoustic device having a housing with a sound hole formed thereon and a speaker unit accommodated in the housing. The speaker unit has a central part, an edge part surrounding the central part and a first strength means formed on the central part for reinforcing rigidity thereof. The first strength means has a first section away from the sound hole and a second section close to the sound hole, and a rigidity of the first section is less than that of the second section.

19 Claims, 3 Drawing Sheets

ACOUSTIC DEVICE

FIELD OF THE INVENTION

One embodiment of the invention is related to an acoustic device, and more particularly to a speaker box with high audio performance.

DESCRIPTION OF RELATED ART

In modern consumer electronics, audio capability is playing an increasingly larger role as improvements in digital audio signal processing and audio content delivery continue to happen. There is a range of consumer electronics devices that are not dedicated or specialized audio playback devices, yet can benefit from improved audio performance. For instance, smart phones are ubiquitous.

In a typical acoustic device, such as a speaker or a speaker box, a sound radiation surface is provided for generating sound. Generally, the sound radiation surface is a membrane or a diaphragm which is activated by an electrified voice coil. While activated, the sound radiation surface vibrates and produces audible sounds. Recently, the speaker box often defines a sound hole on the sidewall of the speaker box. When operates the speaker box and the voice coil vibrates, a sound resistance in an area close to the sound hole is less than that in an area away from the sound hole. Thus, an unbalance vibration occurred while the voice coil vibrating, which results in a distortion of the sound generated from the speaker box, and some other defaults in the speaker box.

Therefore, an improved acoustic device is provided in the embodiment of the present disclosure to solve the problem mentioned above.

Figure 1:
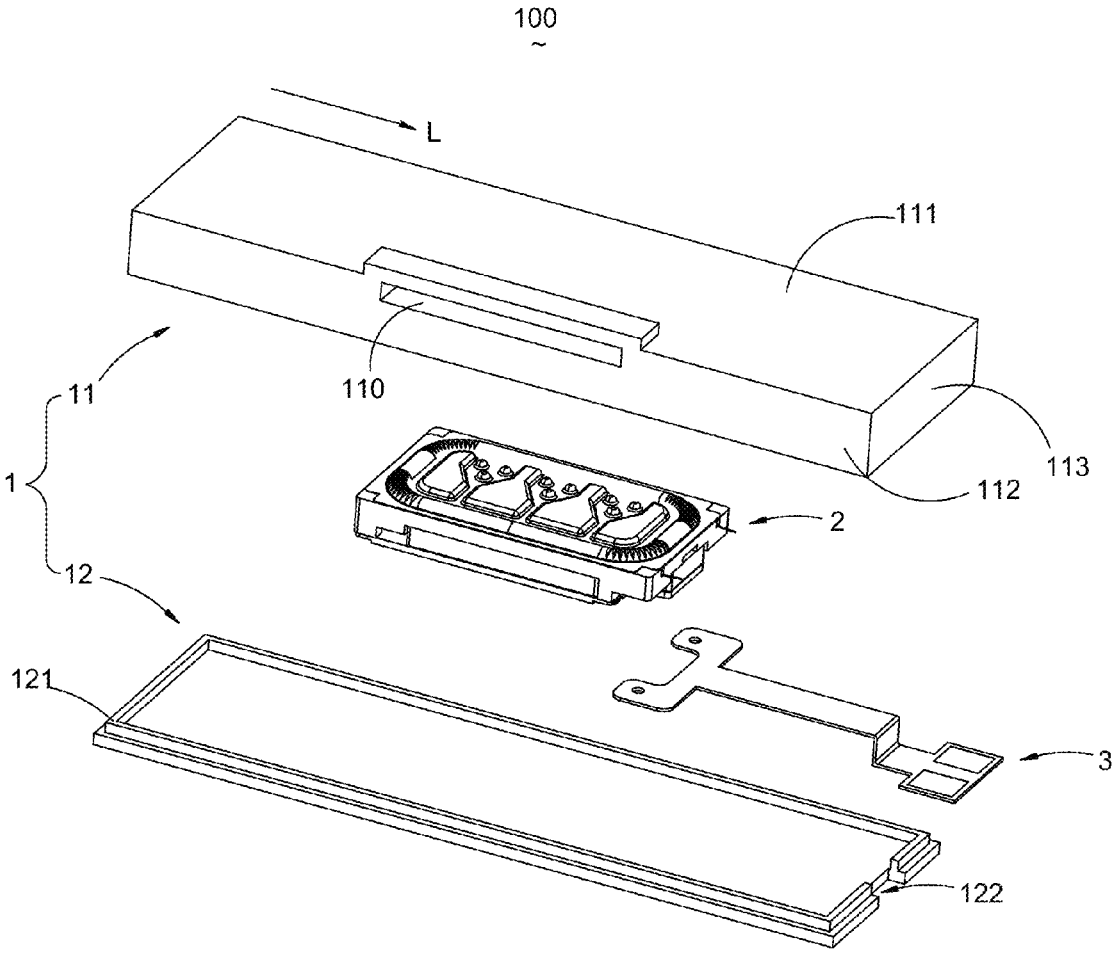
FIG. 1 is an exploded isometric view of an acoustic device related to the present invention.

Many aspects of the embodiment can be better understood with reference to the drawings mentioned above. The components in the drawings are not necessarily drawn to scale, the emphasis instead being placed upon clearly illustrating the principles of the present disclosure. Moreover, in the drawings, like reference numerals designate corresponding parts throughout the several views.

DETAILED DESCRIPTION OF THE EXEMPLARY EMBODIMENT

Reference will now be made to describe an exemplary embodiment of the present invention in detail. In this section we shall explain several exemplary embodiments of this invention with reference to the appended drawings. Whenever the shapes, relative positions and other aspects of the parts described in the embodiment are not clearly defined, the scope of the invention is not limited only to the parts shown, which are meant merely for the purpose of illustration. Also, while numerous details are set forth, it is understood that some embodiments of the invention may be practiced without these details. In other instances, well-known structures and techniques have not been shown in detail so as not to obscure the understanding of this description.

Figure 2:
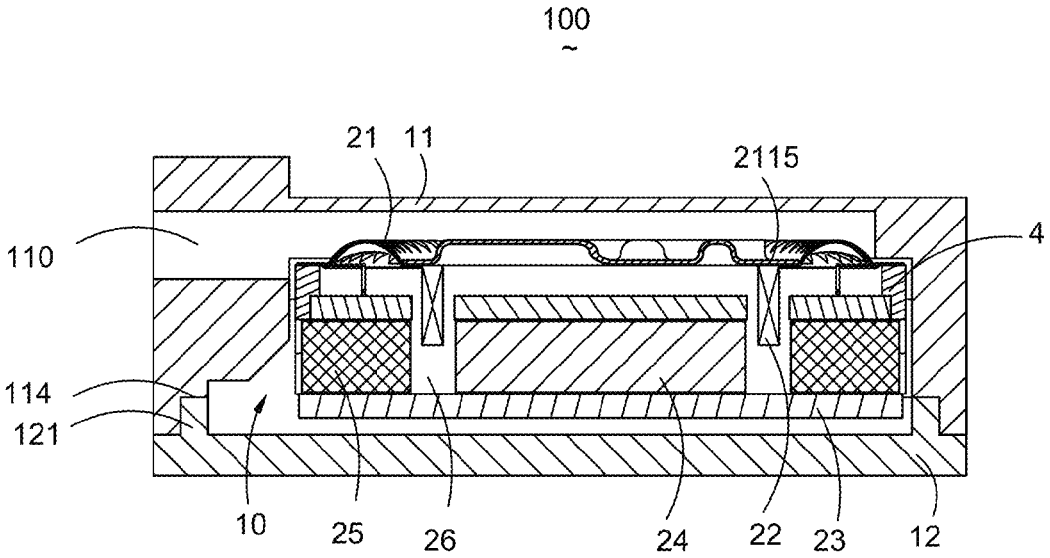
FIG. 2 is a cross-sectional view of the acoustic device in FIG. 1.

Referring to FIG. 1 and FIG. 2, an acoustic device 100 according to an exemplary embodiment includes a housing 1 having a cover 11 and a mounting plate 12 assembled with the cover 11 for forming a receiving space 10, a speaker unit 2 received in the receiving space 10 and an electric terminal 3 electrically connected with the speaker unit 2 and extends out of the receiving space 10 for connecting to outer circuit.

The cover 11 has a rectangular box shape, and includes a rectangular top wall 111 defining a length direction L, a pair of first sidewalls 112 extending substantially perpendicular to the top wall 111 in the length direction L and a pair of second sidewalls 113 extending substantially perpendicular to the top wall 111 in a direction perpendicular to the length direction L. A through window 110 for transmitting sound generated by the speaker unit 2 to outside is formed in one of the first sidewalls 112 or one of the second sidewalls 113. The through window 110 has a slit shape and communicates with the receiving space 10. In this embodiment, the through window 110 is formed in the first sidewall 112 in the length direction L. The first sidewalls 112 and second sidewalls 113 are provided with depressions 114 that are recessed in a direction toward the top wall 111.

The mounting plate 12 has a rectangular shape with a dimension substantially equal to the top wall 111. The mounting plate 12 has a ring shaped projection 121 protruding toward the top wall 111 of the cover 11 for accommodating into the depressions 114 to assemble with the cover 11. The mounting plate 12 further defines a cut-out portion 122 in one side thereof, via which the electronic terminal 3 leads out of the cover 11.

The speaker unit 2 includes a vibration unit, a magnetic circuit unit and a frame 4 for containing the magnetic circuit unit. The vibration unit comprises a diaphragm 21 and a voice coil 22 connected with the diaphragm 21 for driving the diaphragm 21 to vibrate. Optionally, the voice coil 22 may be connected to the diaphragm 21 via a medium which is directly connected with the diaphragm 21. In other words, the voice coil 22 may be connected to the diaphragm 21 directly or indirectly. Therefore, the term "connect" here means to connect something to another via a medium or to connect something to another directly without any medium.

The magnetic circuit unit comprises a base board 23, a first magnetic conduction member 24 disposed on a center portion of the base board 23, a second magnetic conduction member 25 disposed on a periphery portion of the base board 23 for forming a magnetic gap 26 together with the first magnetic conduction member 24. The base board 23 is made of magnetic conduction materials for effectively conducting magnetic fluxes. At least one of the first and second magnetic conduction members 24, 25 is a permanent magnet. In this embodiment, both the first and second magnetic conduction members 24, 25 are permanent magnets. In an alternative embodiment, the first magnetic conduction member is a permanent magnet and the second magnetic conduction member is made of magnetic conduction materials for effectively conducting magnetic fluxes. Furthermore, the second magnetic conduction member and the base board are formed an integral unit. On the contrary, the first magnetic conduction member is made of magnetic conduction materials for effectively conducting magnetic fluxes and the second magnetic conduction member is a permanent magnet. The first magnetic conduction member and the base board are formed an integral unit.

Figure 3:
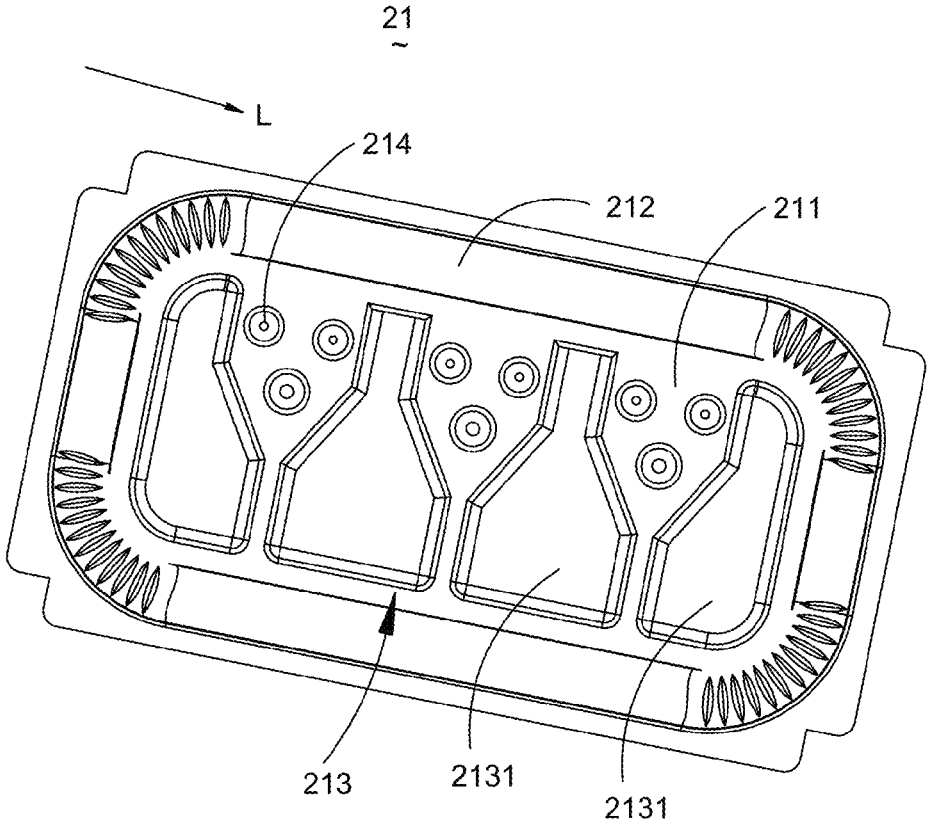
FIG. 3 is an illustrative isometric view of a diaphragm of the acoustic device in FIG. 1
Figure 4:
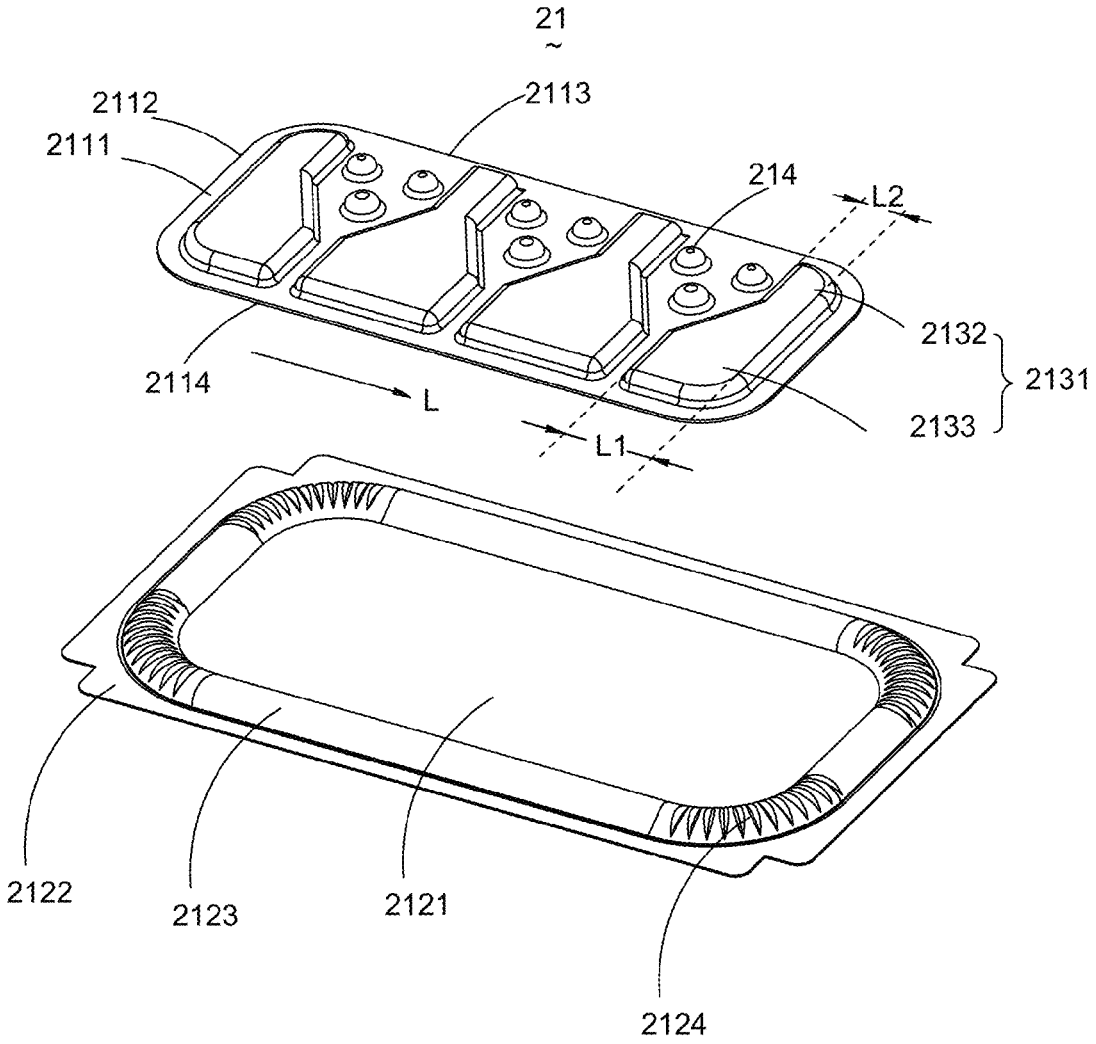
FIG. 4 is an exploded isometric view of the diaphragm in FIG. 3.

As shown in FIGS. 2-4, the diaphragm 21 has a rectangular shape, is parallel to the top wall 111 of the cover 11, and includes a dome 211 and a suspension 212 surrounding the dome 211. The suspension 212 includes a flat portion 2121 for supporting the dome 211, an edge portion 2122 for fixing on the frame 4 and a connecting portion 2123 connected between the flat portion 2121 and the edge portion 2122. The dome 211 is attached onto the flat portion 2121 by normal means, such as gluing, adhesive and so on. Alternatively, the dome 211 and the flat portion 2121 may be integrally formed as one unit. The connecting portion 2123 protrudes out of the flat portion 2121 and the edge portion 2122. A plurality of corrugations 2124 are formed on four corners of the connecting portion 2123, respectively. In this embodiment, the number of the corrugations 2124 in each corner equals to each other.

The dome 211 has a rectangular shape and is parallel to the top wall 111 of the cover 11. The dome 211 includes an upper surface 2111 facing the top wall 111 of the cover 11 and a lower surface 2115 opposite to the upper surface 2111. The dome 211 includes a pair of length sides extending in the length direction L of the top wall 111 of the cover 11 and a pair of shorter sides 2112 extending in a direction perpendicular to the length direction L. The length sides are divided into a first length side 2113 away from the through window 110 of the cover 11 and a second length side 2114 opposite to the first length side 2112.

The diaphragm 21 further comprises a first strength member 213 attached on the upper surface 2111 of the dome 211. The first strength member 213 and the dome 211 may be integrally formed as one unit. Alternatively, the first strength member 213 and the dome 211 may be separated part, which are connected with each other by normal means, such as gluing, adhesive, and so on.

In this embodiment, the first strength member 213 includes four first strength parts 2131 disposed on the upper surface 2111 of the dome 211, juxtaposed with each other in the length direction L and spaced from each other. Each of the first strength parts 2131 protrudes toward the top wall 111 from the upper surface 2111 and extends from the second length side 2114 toward the first length side 2113. Alternatively, the first strength part 2131 may be a recess that is recessed in a direction away from the top wall 111. Each of the first strength parts 2131 has a first portion 2132 close to the first length side 2113 and a second portion 2133 opposite to the first portion 2132. A rigidity of the second portion 2133 is higher than that of the first portion 2132. A length L1 of the second portion 2133 in the length direction L is higher than a length L2 of the first portion 2132. Optionally, the length of each first strength part 2131 in the length direction L is gradually reducing from the second portion 2133 to the first portion 2132. In this embodiment, the first strength parts may have the same shape. Alternatively, the first strength parts may have different shapes. The number of the first strength part is not limited to this, and it may be variable as long as the rigidity of the second portion is higher than that of the first portion.

In this embodiment, the diaphragm 21 further comprises a plurality of second strength members 214, disposed between two adjacent first strength parts 2131 and close to the first side 2113. Specifically, the second strength members 214 are disposed between the first sections 2132 of two adjacent first strength parts 2131. Each second strength members 214 has a hemispheric shape and protrudes toward the top wall 111 of the cover 11 from the upper surface 2111 of the dome 211. The number of the second strength members 214 disposed between two adjacent first strength parts 2131 is variable according to the requirement of the rigidity of the dome 211. With the construction of the second strength members, the rigidity of the dome can be adjusted according to the actual requirement. Furthermore, the rigidity of the area close to the through window of the cover and the area away from the through window can be adjusted according to the actual requirement.

While the present disclosure has been described with reference to the specific embodiment, the description of the disclosure is illustrative and is not to be construed as limiting the disclosure. Various of modifications to the present disclosure can be made to the exemplary embodiment by those skilled in the art without departing from the true spirit and scope of the disclosure as defined by the appended claims.

What is claimed is:

1. An acoustic device, comprising:

a cover having a top wall and a plurality of sidewalls connected with the top wall;

a mounting plate assembled with the cover for forming a receiving space;

a speaker unit received in the receiving space, wherein, the cover further defines a through window formed in one of the sidewalls for transmitting sound generated by the speaker unit to outside;

the speaker unit has a diaphragm including a dome, a suspension surrounding the dome and a first strength member attached on the dome;

the first strength member comprises a plurality of first strength parts disposed on the dome, juxtaposed with each other and spaced from each other, each of the first strength parts having a first portion away from the through window and a second portion opposite to the first portion; and a rigidity of the second portion is higher than that of the first portion.

2. The acoustic device of claim 1, wherein, the dome includes an upper surface facing the top wall and a lower surface opposite to the upper surface; and the first strength member is formed on the upper surface.

3. The acoustic device of claim 1, wherein, the first strength member and the dome are formed integrally as one unit.

4. The acoustic device of claim 2, wherein, the cover has a rectangular box shape and defines a length direction;

the through window is formed in the sidewall in the length direction and has a slit shape.

5. The acoustic device of claim 4, wherein, the dome has a pair of length sides extending in the length direction of the cover and a pair of shorter sides extending in a direction perpendicular to the length direction.

6. The acoustic device of claim 5, wherein, the first strength parts disposed on the upper surface of the dome and juxtaposed with each other in the length direction.

7. The acoustic device of claim 6, wherein, each first strength part protrudes toward the top wall from the upper surface of the dome and extends from one length side toward the other length side of the dome.

8. The acoustic device of claim 7, wherein, a length of the first portion in the length direction is less than that of the second portion.

9. The acoustic device of claim 8, wherein, a length of the first strength part in the length direction is gradually reducing from the second portion to the first portion.

10. The acoustic device of claim 9, wherein, the diaphragm further includes a plurality of second strength members protruding toward the top wall of the cover from the upper surface of the dome, disposed between two adjacent first strength parts and away from the through window.

11. The acoustic device of claim 10, wherein, each second strength member has a hemispherical shape.

12. An acoustic device, comprising:

a housing having an accommodating space with a sound hole formed therein and communicating with the accommodating space;

a speaker unit received in the accommodating space having a central part, an edge part surrounding the central part and a first strength means formed on the central part for reinforcing rigidity thereof; wherein, the first strength means includes a plurality of first strength parts disposed on the central part, juxtaposed with each other and spaced from each other; each of the first strength parts having a first section away from the sound hole and a second section close to the sound hole, and the rigidity of the first section is less than that of the second section.

13. The acoustic device of claim 12, wherein, the housing has a rectangular box shape and defines a length direction;

the sound hole is formed in a sidewall of the housing in the length direction and has a slit shape.

14. The acoustic device of claim 13, wherein, the first strength parts are juxtaposed with each other in the length direction.

15. The acoustic device of claim 14, wherein, the central part has a pair of length sides extending in the length direction; each first strength part protrudes toward the housing from the central part and extends from one length side toward the other length side of the central part.

16. The acoustic device of claim 15, wherein, a length of the first section in the length direction is less than that of the second section.

17. The acoustic device of claim 16, wherein, a length of the first strength part in the length direction is gradually reducing from the second section to the first section.

18. The acoustic device of claim 17, wherein, the speaker unit further includes a plurality of second strength members protruding toward the housing from the central part, disposed between two adjacent first strength parts and away from the sound hole.

19. The acoustic device of claim 18, wherein, each of the second strength members has a hemispherical shape.

* * * * *